US005570748A

United States Patent [19]

Serrette

[11] Patent Number: 5,570,748

[45] Date of Patent: Nov. 5, 1996

[54] DRILL BIT FOR GEOLOGICAL EXPLORATION

[76] Inventor: Billy J. Serrette, 1043 Mustang Cir., St. Martinville, La. 70582

[21] Appl. No.: 542,285

[22] Filed: Oct. 12, 1995

Related U.S. Application Data

[60] Division of Ser. No. 395,890, Feb. 28, 1995, Pat. No. 5,488,999, which is a continuation-in-part of Ser. No. 229, 725, Apr. 19, 1994, abandoned.

[51] Int. Cl.[6] ..... E21B 10/40

[52] U.S. Cl. ..... 175/21

[58] Field of Search ..... 175/19, 21, 414, 175/418; 407/102–105

[56] References Cited

U.S. PATENT DOCUMENTS

| | | | |
|---|---|---|---|
| 54,144 | 4/1866 | Hamar . | |
| 701,992 | 6/1902 | Bowen . | |
| 711,506 | 10/1902 | Johnston . | |
| 774,071 | 11/1904 | Griffith . | |
| 777,351 | 12/1904 | Raymond . | |
| 845,120 | 2/1907 | Raymond . | |
| 848,395 | 3/1907 | Raymond . | |
| 1,017,743 | 2/1912 | Fitzgerald . | |
| 1,304,167 | 5/1919 | Dunham . | |
| 2,313,625 | 3/1943 | Cobi | 61/79 |
| 2,755,734 | 7/1956 | Smith | 102/22 |
| 3,075,424 | 1/1963 | McMackin et al. | 86/21 |
| 3,100,542 | 8/1963 | Stark | 175/1 |
| 3,106,258 | 10/1963 | Muller | 175/55 |
| 3,188,906 | 6/1965 | Beck | 86/20 |
| 3,199,399 | 8/1965 | Gardner | 86/20 |
| 3,242,999 | 3/1966 | Garner | 175/19 |
| 3,367,442 | 2/1968 | Setser | 181/0.5 |
| 3,394,766 | 7/1968 | Lebelle | 173/49 |
| 3,410,353 | 11/1968 | Martini | 173/73 |
| 3,430,719 | 3/1969 | White | 175/412 |
| 3,434,549 | 3/1969 | Lowe | 175/1 |
| 3,463,256 | 8/1969 | White | 175/412 |
| 3,590,738 | 7/1971 | Holzman | 102/21 |
| 3,702,635 | 11/1972 | Farr | 166/299 |
| 3,752,242 | 8/1973 | Gremillion | 175/108 |
| 3,804,182 | 4/1974 | Adair et al. | 175/1 |
| 3,833,071 | 9/1974 | Koosman et al. | 175/57 |
| 3,856,095 | 12/1974 | Adair et al. | 175/203 |
| 3,920,083 | 11/1975 | Makita | 173/49 |
| 3,939,771 | 2/1976 | McReynolds | 102/21.8 |
| 4,240,349 | 12/1980 | Lash | 102/24 R |
| 4,471,669 | 9/1984 | Seaberg | 74/687 |
| 4,553,443 | 11/1985 | Rossfelder et al. | 74/22 R |
| 4,819,740 | 4/1989 | Warrington | 173/49 |
| 4,921,057 | 5/1990 | Smet | 175/203 |
| 5,193,626 | 3/1993 | Jacob | 173/197 |
| 5,281,775 | 1/1994 | Gremillion | 181/116 |
| 5,488,999 | 2/1996 | Serrette | 175/21 |

*Primary Examiner*—Roger J. Schoeppel

*Attorney, Agent, or Firm*—W. Thomas Timmons; Timmons & Kelly

[57] ABSTRACT

A drill bit (10) for drilling geophysical exploratory holes using a non-rotating drill approach is disclosed. The bit (10) includes a tubular body (12) threaded at one end for engagement with a pipe stem. The elements (16*a –b*) of a divided conical tip (14) are hinged to a second end (20) of the bit body (12). The wall thickness of the bit body (12) gradually increases from the first end (18) to the second end (20) to create, when the divided elements (16*a–b*) of the tip are closed, a generally diamond-shaped cross section facilitating burrowing when forced into the soil. An O-ring (36) installed in a groove (34) about the outer circumference of the tip (14) biases divided elements (16*a–b*) closed until a selected tool is loaded through the interior of the bit body (12), whereupon the divided elements (16*a–b*) are forced to rotate radially outward. The bit (10) can then be raised and removed from the borehole as desired.

23 Claims, 2 Drawing Sheets

DRILL BIT FOR GEOLOGICAL EXPLORATION

This is a division of 08/395,890 filed Feb. 28, 1995, now U.S. Pat. No. 5,488,999 which is a continuation-in-part of application Ser. No. 08/229,725, filed Apr. 19, 1994, now abandoned.

BACKGROUND OF THE INVENTION

1. Technical Field

The invention relates to seismic prospecting and geological exploration, and more particularly to seismic prospecting in marshy areas lacking significant areas of dry ground.

2. Background Art

Land based seismic prospecting is a well established art. Generally, it requires at least one source fired to impart a signal into the ground, the signal is reflected by underground formations, and is received by at least one receiver. The received signal is then stored and analyzed to glean information about the underground formations.

Geologic exploration or prospecting operations of this sort generally require a close coupling between the source and the ground. Sources are frequently placed in shallow boreholes known as "shotholes" and coupled to the ground in the shothole. One common source is an explosive charge, which is commonly placed on the ground surface or at the bottom of a shothole and then detonated at a predetermined time. As with all basic types of sources, a firm coupling with the ground is required.

Marshy areas present particular problems in land based seismic prospecting or exploration, especially with respect to coupling. The current approach to positioning explosive charges is to place them in a hollow metal tube at the end of some pipe stem, push the charge into the damp, unstable soil as far as possible, and then deposit the charge. One unfortunate result from this approach is that it frequently results in poor coupling with the ground because the soil is too unstable. This in turn yields unreliable information about the underground formation. However, it is not possible to force the charge deeper with external force on the pipe stems at the surface without collapsing the cage and damaging the charge.

It is therefore a feature of this invention to provide a drill bit for use in marshy areas to obtain superior coupling between the charge and the ground.

It is a further feature of this invention that the bit is for use with non-rotating drilling.

It is still a further feature of this invention that it can employ a hammer-type approach to drilling.

DISCLOSURE OF INVENTION

The invention is a drill bit for drilling shotholes and the like using a non-rotating, pushed or hammered drill approach. The bit generally comprises a tubular body threaded at one end for engagement with a pipe stem. The elements of a divided, generally conical tip are hinged to a second end of the bit body. The wall thickness of the bit body preferably gradually increases from the first end to the second end to create, when the divided elements of the tip are closed, a generally diamond-shaped cross section facilitating burrowing when hammered or pushed. A biasing means closes the divided elements until the charge or other tool is loaded or pushed through the interior of the bit body, whereupon the divided elements are forced to rotate radially outward. The bit can then be raised and removed from the shothole while the charge remains deposited and fully coupled.

BRIEF DESCRIPTION OF DRAWING

A more particular description of the invention briefly summarized above is available from the exemplary embodiments illustrated in the drawing and discussed in further detail below. Through this reference, it can be seen how the above cited features, as well as others that will become apparent, are obtained and can be understood in detail. The drawings nevertheless illustrate only typical, preferred embodiments of the invention and are not to be considered limiting of its scope as the invention may admit to other equally effective embodiments.

MODE(S) FOR CARRYING OUT THE INVENTION

Figures 1, 2, 3, 4:
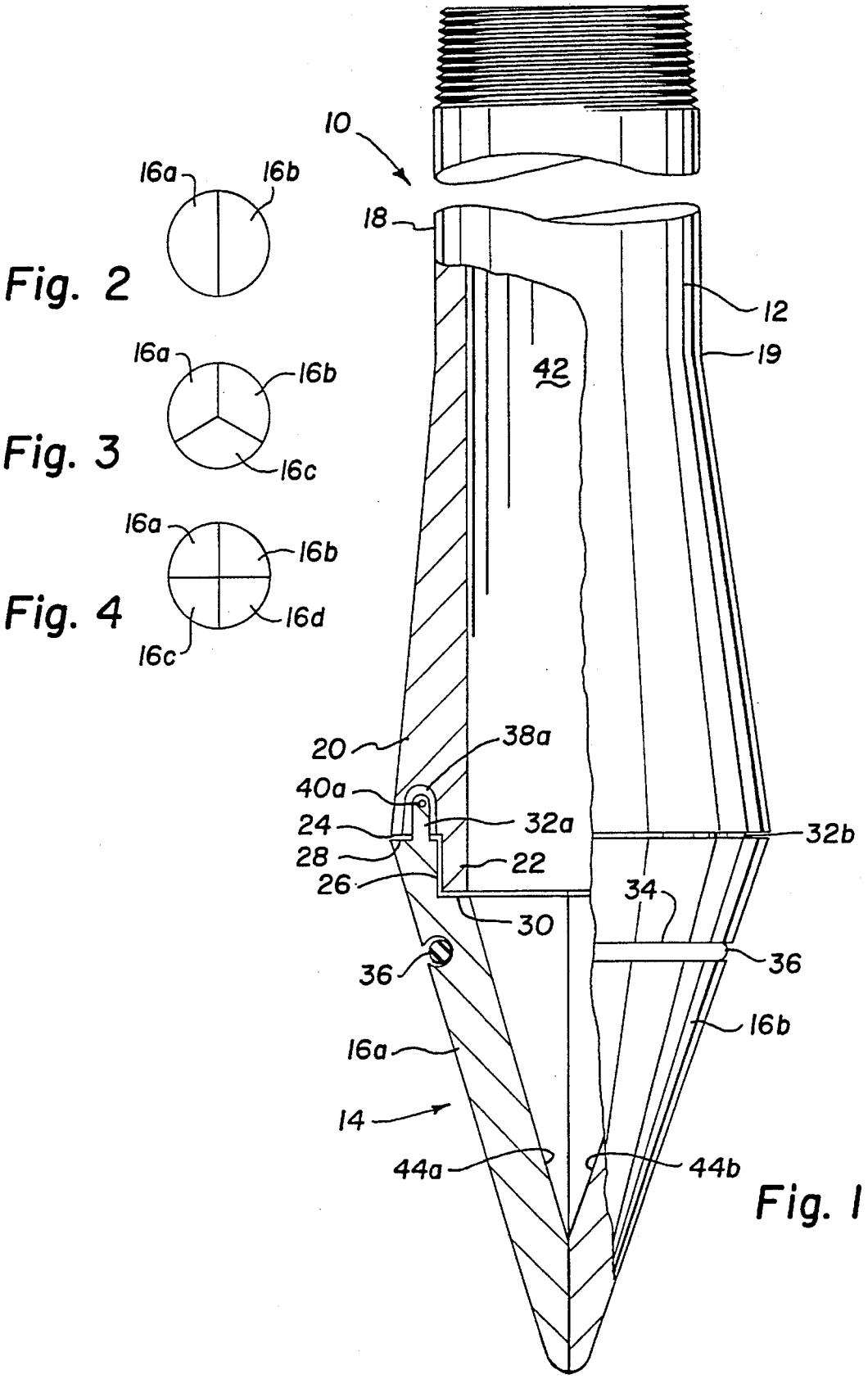
FIG. 1 is a sectional view of the invention.
FIG. 2 is a "bottom" view of the invention as depicted in FIG. 1.
FIGS. 3–4 illustrate embodiments alternative to that in FIG. 1–2 from the same view as in FIG. 2.

The preferred embodiment of the invention 10 is illustrated in FIGS. 1–2. The invention 10 primarily comprises a tubular body 12 to which a generally conical tip 14 is hingedly affixed. As best shown in FIG. 1, tip 14 is both hollow and divided into two hinged divided elements or jaws 16*a–b*. End 18 of body 12 is threaded in a manner well known in the art for engagement with additional lengths of pipe.

Body 12, in more particular detail, has a substantially constant inner diameter or bore 42 and at end 18 has a substantially constant outer diameter. However, the outer diameter optionally gradually increases radially outward from point 19 toward end 20 of body 12 where tip 14 is hingedly affixed so that the wall thickness gradually increases. Body 12 terminates at end 20 in flange 22 defined by a reduced outer diameter that, in turn, defines complementary shoulder 24.

Each of divided elements 16*a–b* has a substantially constant wall thickness as best shown in FIG. 1. At the base of tip 14, however, complementary recess 26 is formed in hinge divided elements 16*a–b* by a sharply increased inner diameter thereby creating second and third shoulders 28 and 30. Hinge members 32*a–b* extend from second should 28. Tip 14 also includes groove 34 in which biasing means 36, an O-ring in the preferred embodiments, is installed.

Divided elements 16*a–b* of tip 14 may be hinged to body 12 in any effective manner known to those in the art. In the preferred embodiment hinge members 32*a–b* extend into hinge grooves 38–*b* respectively and are held by pins 40*a–b*. Hinge grooves 38–*b* are recessed in a manner not shown allowing hinge member 32*a–b* to rotate outwardly about pins 40*a–b* as divided elements 16*a–b* are separated as described below. The important characteristics of the hinge design are that it (1) allows for free outward rotation of divided elements 16*a–b* without binding, and (2) not unduly hampers the ability to drive the invention 10 into the ground.

When divided elements 16*a–b* of tip 14 are affixed to body 12 as described immediately above, recess 26 mates with flange 22 so that the base of tip 14 loosely collars flange 22 when divided elements 16*a–b* are closed. This construction also creates a roughly diamond-shaped cross section best seen in FIG. 1 facilitating the boring function. Generally, an elongate diamond-shaped cross section is preferred, but shortened cross sections will also work although less efficiently.

Figure 5:
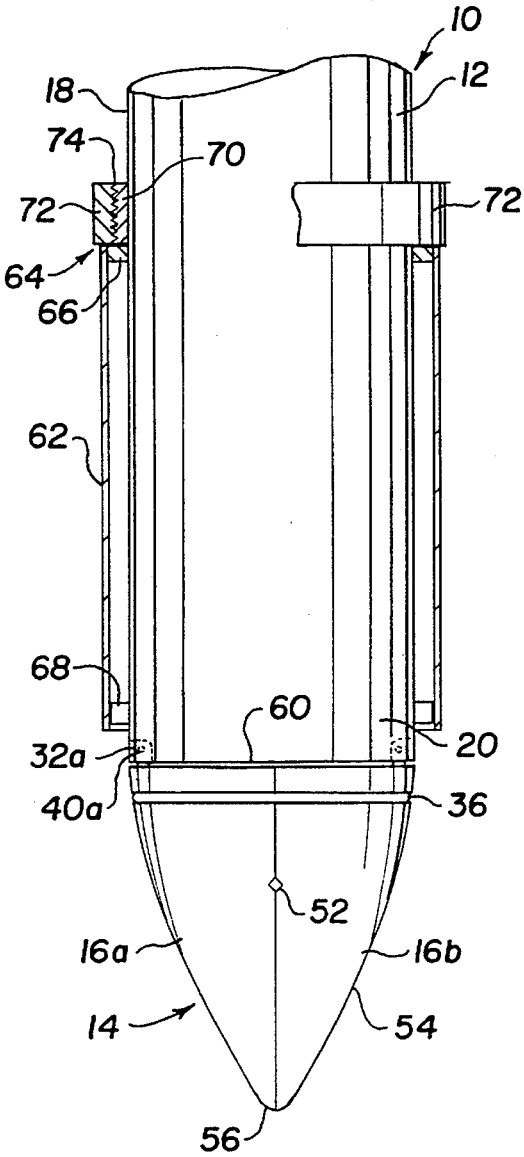
FIGS. 5–6 show yet another alternative embodiment that includes a slidable hood.
Figure 7:
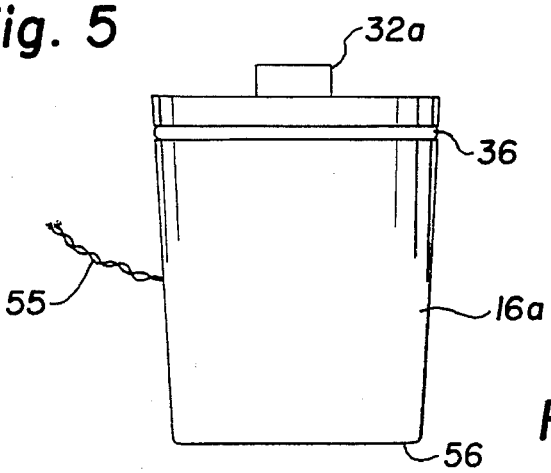
FIG. 7 is a "side" view of one blade for the tip shown in FIG. 5.

Referring to FIGS. 5 and 7, an alternative configuration for the divided elements or jaws 16*a–b* is shown. The tip 14 of FIGS. 5 and 7 includes two elements or blades 16*a–b* shaped in the form of a duckbill or clam-shell byway of example. The exterior surface 54 of the divided elements 16 is bulbous and may have a flattened lower end 56.

Hinges such as 32*a* with cooperating pins 40*a* mount the jaws 16*a–b* to a flat edge 60 of the second end 20 of the tubular body 12. A stop block 58 (FIG. 6) may be mounted with the flat edge 60 of the second end 20 to help in the positioning of the two jaws 16*a–b* when closed.

The invention 10 is used by threadably engaging body 12 to the end of a pipe stem (not shown), as is well known in the art. Biasing means 36 is then activated to close divided elements 16*a–b*. In the preferred embodiment, this is done by installing an O-ring made of an elastomeric material in groove 36. The invention 10 is then forced or hammered into the marshy surface and the unstable soil until it meets firm resistance, whereafter external pressure is vertically applied to the surface end of the pipe stem. In the preferred embodiment, this may be done by hammering the surface end of the pipe stem with repeated sharp blows or using a rig that pushes or forces the pipe string down into the ground.

Once the invention 10 is situated in soil suitably stable to provide adequate coupling, a charge or other selected tool 46 is loaded into the shothole through interior passage or bore 42 of tubular body 12. As the bottom 48 of the charge or tool 46 contacts the sloping inner surfaces 44*a–b* of divided elements 16*a–b*, some of the vertical force is transferred horizontally and begins to act radially against biasing means 36 and the pressure exerted by contact with the stable soil. Rod 50 extending between the tool 46 and the surface through bore 42 may be used to transfer the force down the hole to the tool 46.

Biasing means 36 and the pressure from the stable soil are eventually overcome and divided elements 16*a–b* are rotated radially outward. When divided elements 16*a–b* are sufficiently opened to allow firm coupling between the charge and the stable soil, the invention 10 is raised by the pipe stem and removed from the borehole. Because body 12 is tubular and divided elements 16*a–b* are opened, the charge remains deposited and coupled with the stable soil.

The tool 46 may be any well known in the geophysical exploration art. Examples in addition to the explosive charge for soundings include a core sampler, geophysical microphones ("geophones"), gas samplers, and the like. The present invention may also be used to place or secure objects at the bottom of the holes, such as road or bridge supports or anchors.

Optionally, one or more of the blades 16*a–b* may be formed having a groove or channel 52 therethrough or between to pass a lead cord 54 from the exterior of the tip 14 to its interior. Such a lead cord 55 may be connected the tool and passage through the groove 52 between two blades 16*a–b* would permit the tip 14 to be withdrawn from the hole while the lead cord 54 remains connected to a tool that is being left at the bottom of the hole. An example of such a use would be with a geophone and its connecting electrical lead wire.

The invention includes satisfactory embodiments alternative to that shown in FIGS. 1 and 5. For instance, FIGS. 3–4 illustrate embodiments having two, three, and four hinged divided elements, with like parts of FIG. 3–4 and FIG. 2 bearing like numbers.

Alternative embodiment

Figure 6:
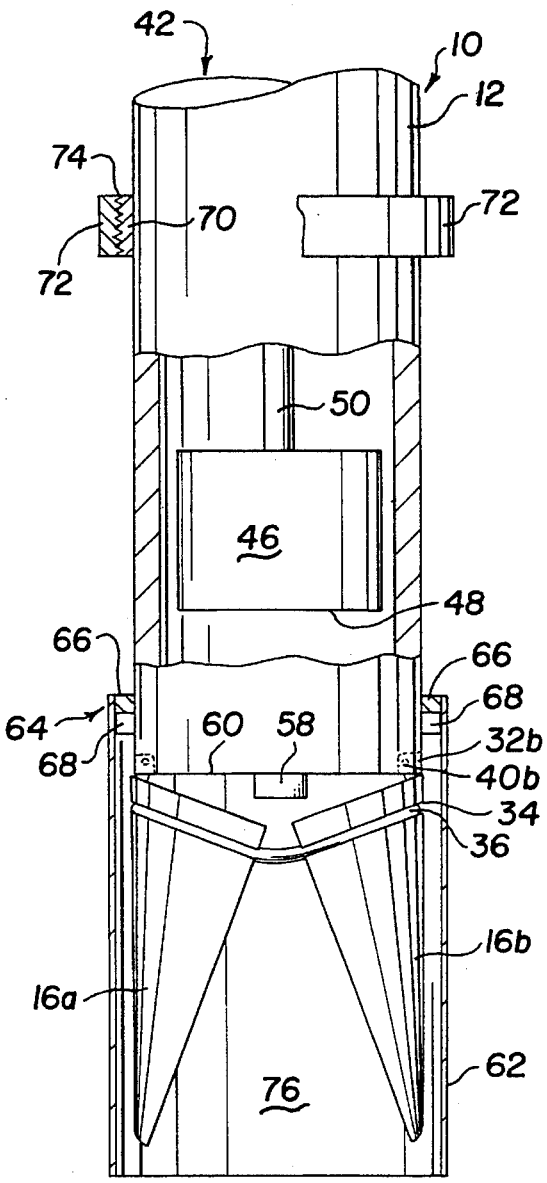

Referring now to FIGS. 5–6, yet another embodiment of the present invention includes a removable tubular hood member 62 mounted about the second end 20 of the tubular body 12. An upper end 64 of the hood 62 is formed having a lip or stop ring 66. Another stop ring or block 68 is mounted at the bottom of the second end 20 of the tubular body 12. A second tubular or upper stop ring 70 that cooperates by thread 74 with an outer ring 72 is attached to the first end 18 of the tubular body 12. The hood 62 is thus permitted to slide from a position shown in FIG. 5 to a position shown in FIG. 6, and is restrained by the movement of stop ring 66 sliding along the tubular body 12 between the lower stop 68 and upper stop 70. Removal of the stop rings 70 and 72 permits the detachment of the hood 62 from the tubular body 12.

In operation of the sliding hood embodiment, when the drill bit 10 is withdrawn from the hole, the exterior of the hood 62 tends to stay in place, relative to the hole, due to friction or contact with the sides of the borehole. The tip 14 first will retract into the interior of the hood 76 until the stop ring 66 of the hood 62 abuts against the lower stop 68. Thereupon, any further withdrawal of the drill bit would pull both the hood 62 and tip 14 out of the hole. Such a procedure tends to prevent the bottom of the borehole from collapsing while the drill string is being withdrawn.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. A method for drilling a exploratory geophysical hole comprising the steps of:

forcing a tubular bit closed on one end and having an internal passageway through unstable soil until the bit reaches stable soil;

loading a selected tool through the internal passageway of the tubular bit;

opening the closed end of the bit through the action of controllably forcing the tool to engage the bit until the tool contacts the stable soil; and removing the bit from the hole.

2. The method of claim 1, wherein the bit comprises:

a tubular body having a bore and having a first end for coupling with the drill pipe and a second end terminating in a flange defined by a reduced outer diameter;

a hollow, divided conical tip closing the end of the bit, comprising at least two divided elements hinged to the tubular body and the base of the tip having a recess defined by an increased inner diameter that, when the divided elements are closed, loosely collars the flange; and means for biasing the divided elements radially inwardly until opened by a force applied in the hollow of the tip, whereupon the divided elements rotate radially outward.

3. The bit of claim 2, wherein the biasing means is an O-ring constructed of elastomeric material installed in a groove in the outer circumference of the tip.

4. The bit of claim 2, wherein the number of divided elements is two.

5. The bit of claim 2, wherein the number of divided elements is three.

6. The bit of claim 2, wherein the number of divided elements is four.

7. The bit of claim 2, wherein the wall thickness of the tubular body gradually increases toward the second end such that, when the divided elements are closed, the bit has a roughly diamond-shaped cross section.

8. The bit of claim 7, wherein the tubular body has an internal passage having constant inner diameter.

9. The bit of claim 2, wherein the tubular body has an internal passage having constant inner diameter.

10. The bit of claim 2, wherein said conical tip has substantially constant radial, cross-sectional wall thickness.

11. The bit of claim 2, wherein the force opening the divided elements is applied by controllably extending a selected tool through the bore of the tubular body.

12. The method of claim 1, wherein the bit comprises:

a tubular body having a bore and having a first end for coupling with the drill pipe and a second end;

a hollow, divided tip comprising at least two divided, complementary blades hinged to the second end of the tubular body; and means for biasing the divided blades radially inwardly until opened by a force applied in the hollow of the tip, whereupon the divided blades rotate radially outward.

13. The bit of claim 12, wherein the biasing means is an O-ring constructed of elastomeric material installed in a groove in the outer circumference of the tip.

14. The bit of claim 12, wherein the number of divided blades is two.

15. The bit of claim 12, wherein the number of divided blades is three.

16. The bit of claim 12, wherein the number of divided blades is four.

17. The bit of claim 12, wherein the tubular body has an internal passage having constant inner diameter.

18. The bit of claim 12, wherein said tip has substantially constant cross-sectional wall thickness.

19. The bit of claim 12, further including a channel formed through one or more divided blades for passing a lead cord therethrough.

20. The bit of claim 12, further including a tubular hood member mounted about the tubular body and slidably extending about said tip, whereby when the bit is removed from the hole, the tip withdraws into said hood that supports a portion of the hole from collapsing.

21. The method of claim 1, wherein said tool includes a seismic charge.

22. The method of claim 1, wherein said tool includes a core sampler.

23. The method of claim 1, wherein said tool includes a geologic microphone device.

* * * * *